US008582063B2

(12) United States Patent
Comarow et al.

(10) Patent No.: US 8,582,063 B2
(45) Date of Patent: Nov. 12, 2013

(54) OPTICAL TOY

(76) Inventors: Austine Wood Comarow, Las Vegas, NV (US); Rufus Butker Seder, Arlington, MA (US); David Comarow, Las Vegas, NV (US)

( * ) Notice: Subject to any disclaimer, the term of this patent is extended or adjusted under 35 U.S.C. 154(b) by 0 days.

(21) Appl. No.: 13/507,316

(22) Filed: Jun. 20, 2012

(65) Prior Publication Data

US 2012/0289119 A1 Nov. 15, 2012

Related U.S. Application Data

(63) Continuation-in-part of application No. 13/092,796, filed on Apr. 22, 2011, now Pat. No. 8,233,099.

(51) Int. Cl.
*G02F 1/1333* (2006.01)
*G02F 1/1335* (2006.01)
*A63H 33/04* (2006.01)

(52) U.S. Cl.
USPC ..... 349/122; 349/96; 446/85

(58) Field of Classification Search
USPC ..... 349/113, 112; 446/85
See application file for complete search history.

(56) References Cited

U.S. PATENT DOCUMENTS

2001/0010571 A1* 8/2001 Kanou et al. ..... 349/113
2011/0268966 A1* 11/2011 Yun et al. ..... 428/339
2012/0167746 A1* 7/2012 Jacobsen ..... 84/477 R
2012/0206803 A1* 8/2012 Saha ..... 359/485.01

OTHER PUBLICATIONS

Sanritz Corp. Product Information, 2 page web pages downloaded Jan. 26, 2012, <www.sanritz.corp.co.jp/english/products/polarizer/linear_polarizer.html>.
Sanritz Corp, Product Information, 2 web pages downloaded Jan. 26, 2012, <www.sanritz.corp.co.jp/english/products/polarizer/reflector_p.html>.
Orient Display, "FAQs LCD Basics," 4 web pages downloaded Jan. 26, 2012 <http://www.orientdisplay.com/lcds-basis.html>.
Pacific Display Devices, LCD Viewing Modes and Poilarizers, 3 web pages downloaded Jan. 26, 2012, <www.tstonramp.com/~pd-dwebacc/lcd_polarizers.htm>.
James Mann, Austine Wood Comarow: Paintings in Polarized Light, 2005, Wasabi Publishing, Las Vegas, NV USA, pp. 11, 13-15, 18-19 cited. Entire 71 page book provided.
Simon Quellen Field, SciToys.COM, "Building the Impossible Kaleidoscope," http://sci-toys.com/scitoys/scitoys/light/polariscope.html, downloaded Jun. 17, 2012.

* cited by examiner

*Primary Examiner* — Wen-Ying P Chen
(74) *Attorney, Agent, or Firm* — David Comarow

(57) ABSTRACT

Disclosed is a toy comprising polarizing filters and birefringent film cut into shapes used to make temporary colorful birefringent designs. The birefringent film (or, alternatively, the polarizing filter) is coated with non-water soluble, non-hygroscopic low-tack or ultra-low-tack adhesive so that changeable designs can be assembled on the polarizing filter and viewed through polarized spectacles or a polarizing filter. The polarizing filters are retained in rings that can be nested and rotated in relation to each other, or movably attached to each other with magnetic attachments. An embodiment is also disclosed which makes use of the polarized light emitted from certain LCD display devices so that they can be used as a work surface to make changeable birefringent designs. Such an implementation may also use applications executed by or stored on the device to provide design outlines.

14 Claims, 10 Drawing Sheets

OPTICAL TOY

REFERENCE TO PRIOR FILED APPLICATIONS

This application is a Continuation-in-part of application Ser. No. 13/092,796 filed Apr. 22, 2011 titled Temporary Birefringent Color Image Apparatus and Method, now U.S. Pat. No. 8,233,099 the entirety of which is incorporated herein by reference.

GOVERNMENT LICENSE RIGHTS

None.

FIELD OF THE INVENTION

The present invention relates to optical toys, more specifically toys, games and craft apparatuses made with birefringent and polarizing materials to create temporary displays and art.

BACKGROUND

The present invention relates to toys, games and crafts in which changeable images are created using birefringent materials, self-adhering materials or adhesives and polarizing filters to create temporary displays.

The ability to make changeable displays, whether for informational, play, way-finding or decorative purposes, is of great importance. The use of changeable symbols or shapes on a background is widely known. The use of replaceable shapes for games and educational purposes is also well-known. However, the ability to create easily changeable images that produce different colors depending on the angle of orientation of the individual pieces or to create different colors and patterns simply by overlapping these same pieces is new. Further, the application of changeable birefringent images in toys would be a highly desirable function, adding an intriguing, educational and exciting aspect to creating relatively simple artwork.

In 1951 Harry Kislevitz invented what became a popular toy called "ColorForms." This product relied on the surface adhesion properties of certain vinyl and allowed people to create decorative arrangements of various colored shapes on smooth surfaces such as windows or tile. See <http://www.plasticsnews.com/blog/2011/02/happy__60th_to_an_iconic_plasti.html> accessed Apr. 18, 2011. The ColorForms product has essentially remained unchanged for 60 years, but its popularity has decreased owing to lost consumer interest resulting from over-familiarity with the toy, as well as competing activities having changing colors and images such as those using computer displays and the like.

As described above, games utilizing surface adhesive vinyl have been in use since at least 1960. However, interest in such toys has waned. Over the years the approach has been used in such products as pop-up toys and play houses and offered in association with a variety of licensed television and motion picture characters to aid in marketing. A need to modernize and improve this type of activity exists that will effectively compete with electronic distractions of our day.

Several toy-like products have been marketed over the years. However, none has allowed users to make controlled designs that can be changed. For example, kaleidoscope type toys have been known that used polarizing filter and birefringent films. See e.g. http://sci-toys.com/scitoys/scitoys/light/polariscope.html. Such toys provide prismatic colored images, but they are not assembled or designed by the user. A variation on the idea of a polariscope is the subject of U.S. Pat. No. 7,477,386 issued to Saha in 1991 and a Continuation-in-Part issued as U.S. Pat. No. 8,107,076 also to Saha. The '386 and '076 patents are limited to photoelastic materials that are placed under stress to show colors. It does not disclose either birefringent films or temporary adhesion of pre-cut shapes.

At least one puzzle using polarizing filter and birefringent material is the subject of U.S. Pat. No. 4,402,510 issued to Yokoi in 1983. While generally speaking this is a toy, it does not allow users to create changeable artistic images.

There is also great interest in new ways to create decorative objects without the need to use a computer, acquire expensive equipment, to make a mess or even possess advanced artistic skills. Over the years such approaches have included "Paint by Numbers" invented in 1950 by Max Klein and Dan Robbins (see <http://americanhistory.si.edu/paint/introduction.html> accessed Apr. 18, 2011) and plastic faux stained glass (See e.g U.S. Pat. No. 4,302,260 issued to Meltzer). But these types of activities are considered dated and their popularity has also waned. A need exists to provide a simple way to make interesting, colorful images such as window "sun catchers" that change depending on angle of viewing, are iridescent and can be changed easily. Fine art has been created using birefringent materials and polarized light since shortly after plane polarizing filter was invented by Edwin Land in the 1930's. One of the inventors herein, Austine Wood Comarow, has been creating kinetic and interactive fine art work using birefringent films and polarizing filter since 1967 See Mann, "Austine Wood Comarow: Paintings in Polarized Light," 2005, Wasabi Publishing, Las Vegas, Nev. However, such work is permanent in nature and requires extensive training and skills to create. A need, therefore, to create a way for hobbyists to use these materials to create interesting and pleasing decor is therefore needed.

Educational activities, particularly for pre-school children, is considered vital to healthy cognitive development. Over the years many educational toys and other apparatuses have been developed for teaching fundamental childhood educational concepts such as reading. See e.g. U.S. Pat. No. 3,593,433 issued to Dillon in 1970 disclosing a picture board with adherent letters associated with familiar environmental objects. However, in today's world filled with distractions ranging from colorful 3D television to smart phones, holding children's attention is becoming more of a challenge. Therefore, a need exists to provide shapes that become colorful only when viewed through a polarizing sheet ("analyzer"). The "magical" experience of seeing an invisible image suddenly appear in full color and then to be made to immediately change color will aid in keeping the attention of a child.

In developing one embodiment of the present invention, a new type laminated material was needed. It required producing birefringent colors in a controlled and predictable way, it needed to be resilient when handled repeatedly and subjected to light washing and it needed to be repeatedly adherent and removable. Therefore a new combination of birefringent film such as cellophane and surface adherent (also known as "static cling") vinyl was created. The lamination of the birefringent film between two layers of the vinyl created a sturdy, resilient and repeatably adherent lamination from which desired shapes could be cut. An alternative birefringent material was also developed employing one or more layers of biaxially oriented polypropylene (BOPP) and non-water-soluble ultra-low-tack adhesive. The cutting could be accomplished by hand with knives and scissors, by robotic ("X-Y") cutters, by steel rule dies, by laser cutters and by water jet cutters. Steel rule die cutting was determined to be the best mode for mass production due to its low cost and ability to "kiss cut" the lamination on a backing.

Therefore, it is the object of this invention to provide a means for untrained members of the public to make colorful, birefringent displays that can quickly be displayed and easily be changed at will.

It is a further object of the present invention to provide a means to create decorative art objects using birefringent materials and polarized light such that the materials are reusable.

It is a further object of the present invention to make easy-to-change signs that are visible only through polarizing filters and changeable.

It is a further object of the present invention to make toys, crafts and educational products for children and adults using birefringent materials and polarized light to create exciting and intriguing experiences which both stimulate creativity and reinforce the learning experience.

It is a further object of the present invention to provide a laminated material which is both birefringent to produce controllable colors, surface adherent, repeatably reusable, sturdy and cleanable.

It is a further object of the present invention to provide a means to create birefringent polarized light art using birefringent materials coated with low-tack adhesive.

SUMMARY

To fulfill the above objects, we have developed a set of materials and methods especially adapted to this application.

DEFINITIONS

To avoid confusion and ambiguity, and to aid in defining the scope of the invention claimed, as used herein, the following words will be given the construction denoted:

"Analyzer" shall mean a plane polarizing filter through which the display claimed herein is viewed, whether physically attached to or laid over the display, disposed in space between the viewer and the display or worn by the viewer so as to be held the Viewer's field of vision, as spectacle lenses, hand-held or table-top viewing devices.

"Birefringent film" shall mean any clear material which is birefringent and capable of producing colors when illuminated with polarized light and viewed through an analyzer;

"Display" shall mean any visually perceived pattern;

"Low-tack adhesive" shall include without limitation "Ultra-low-tack adhesive."

"Polarizer" shall mean plane polarizing filter producing substantially linearly polarized light;

"Static Cling Vinyl" or "surface-adherent" shall mean any polymer that adheres to a smooth or glossy surface without the use of an adhesive whether by static charge or surface adhesion;

"Toy" shall mean any play or craft device used for games, educational activities, artistic activities, craft activities or the like, for any age group and any skill level.

"Ultra-low-tack Adhesive" shall mean an adhesive that adheres preferentially to the Birefringent Material or Polarizer on which it is disposed as compared with a display surface from which the Birefringent Material or Polarizer can be repeatedly repositioned.

DETAILED DESCRIPTION

The present invention utilizes the unique birefringent properties of certain materials such as cellophane and, in some embodiments, the surface-adhering water-proof properties of certain materials such as plasticized vinyl. By combining the birefringent film with the self-stick properties of the vinyl or low-tack adhesive, we have been able to create a device and method for making easily changeable colorful displays for such uses, without limitation, as signs, games, toys, décor and the like.

Figure 1:
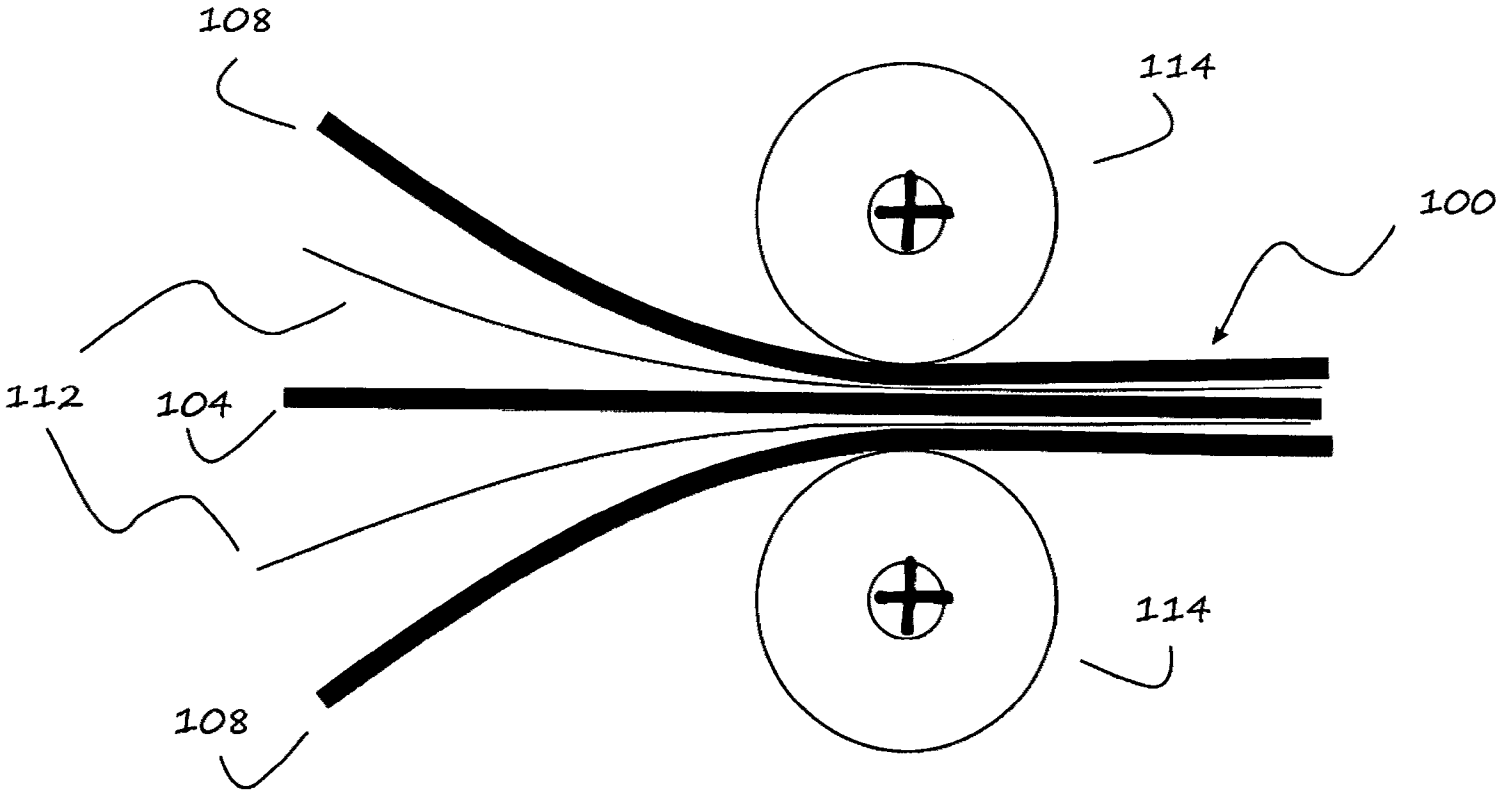
FIG. 1 is a drawing depicting the structure and process of making the lamination of self-stick vinyl and birefringent film.

FIG. 1 depicts the structure and process of making the lamination 100 of the present invention. Birefringent film 104 is laminated between two sheets of surface-adherent vinyl 108 using a non-water soluble adhesive 112 calendared between pressure rollers 114. The birefringent film is preferably comprised of cellophane, but may also be made of a wide variety of materials including, but not limited to biaxially oriented polypropylene (BOPP), polycarbonate, polystyrene, stressed acrylic, polyethylene, polyester, copolymers of polyethylene terephthalate (e.g. PETG) and polyvinylchloride (PVC or "Saran"). The birefringent film 104 may, itself comprise one or more layers of birefringent film laminated to each other to achieve the desired colors in polarized light. Such laminations of birefringent film may use similar non-water-soluble adhesive or heat-sealing polymers such are widely known in the packaging industry and widely used for sealing cellophane packaging. The use of non-water-soluble adhesive 112 for all parts of the lamination 100 assures the lamination will not come apart if it gets wet such as when cleaning. The adhesive 112 may be liquid applied to the components or may be a solid adhesive such as MACtac Permaprint Mounting Film stock number IP 2002. The more impervious to water the adhesive 112 is, and the more complete it coats and seals the birefringent material 104 the better. This is especially true if cellophane is used as the birefringent material 104 as cellophane is hygroscopic. We tested a lamination of cellophane and surface-adherent vinyl using MACtac Permaprint mounting film by boiling it for 5 minutes with no sign of delamination or deterioration. An alternative adhesive for adhering the birefringent material 104 to the surface-adherent vinyl 108 is a heat sealable polymer discussed above and widely used in cellophane manufacturer. However, the minimum sealing temperature must be lower than will cause damage or distortion to the vinyl which can interfere with its adhesion to smooth surfaces or cause optical changes. For this reason, a pressure-sensitive adhesive such as the mounting film disclosed above is preferred.

Figure 2:
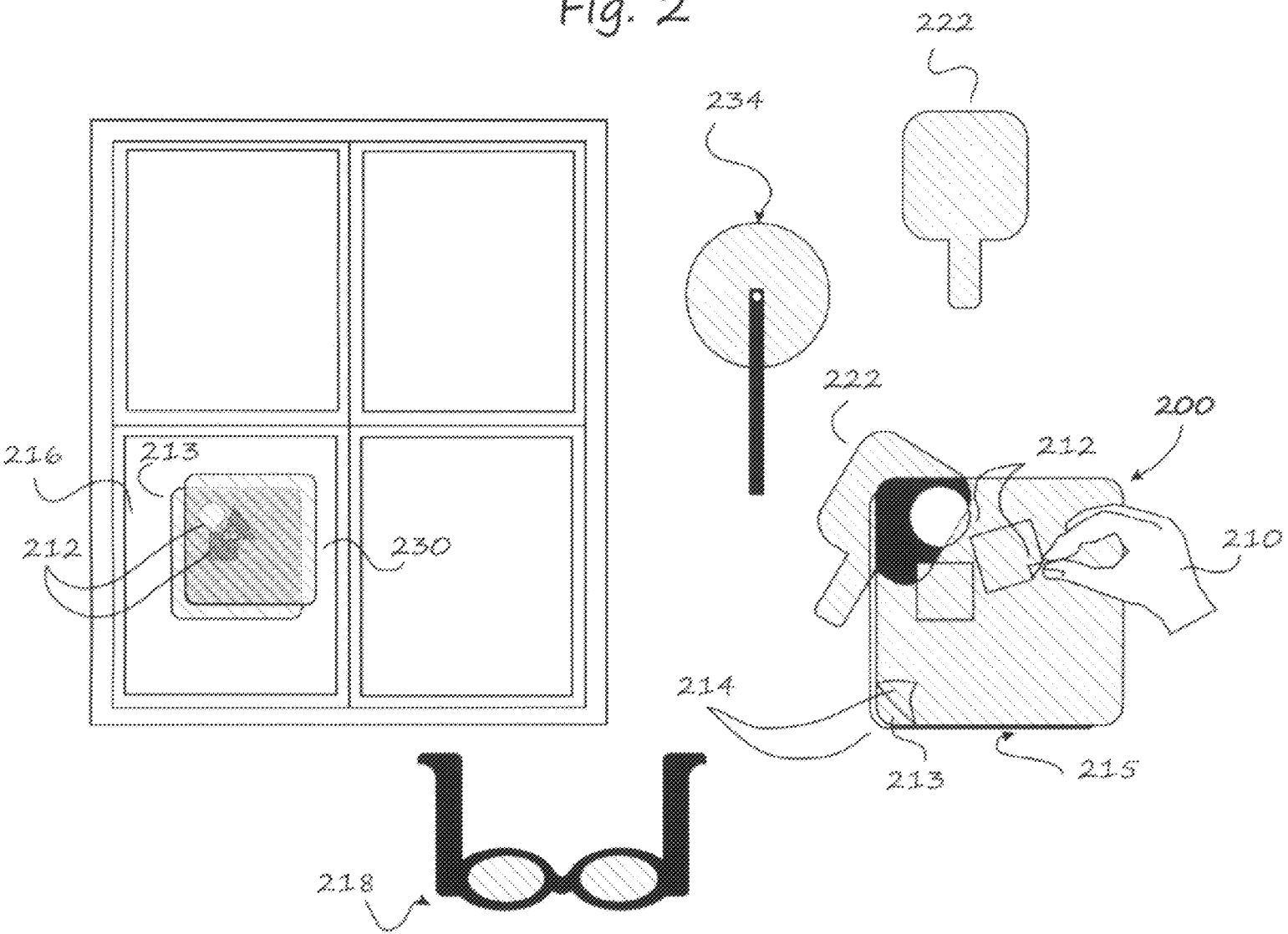
FIG. 2 is an illustration an embodiment of the present invention whereas it is implemented as one type of toy.

FIG. 2 illustrates the use of the present invention as a toy 200 in which the participant 210 peels shapes 212 of the lamination 100 described above and adheres them to a sheet of polarizing material 213. The polarizing material 214 is preferably laminated between two sheets of the same kind of self-adhering vinyl but may also be used directly as the substrate upon which the shapes are adhered. The polarizer shown in FIG. 2 is the transmissive type, so it requires backlight. Here, the participant has placed the polarizer on a window pane 216. Alternatively a light box, flat screen display or other light source may be used. The participant can look through a polarizing analyzer such as polarized spectacles 218 or a polarizing sheet viewer 222 to view the assembly of shapes 226. Once the participant completes the design, a second piece of polarizer (the analyzer) 230 can be adhered over the surface of the design to create a finished artwork that is viewable without the need to look through a separate analyzer such as polarized spectacles or other viewer. Preferably the second polarizer is also made as a lamination of polarizing filter 213 between two pieces of self-stick vinyl 214 forming a lamination 215. Alternatively, the analyzer can be held in place with tape, hung from a suction cup hook or otherwise held over the completed work. The analyzer can also be omitted and viewers can look at the completed work through any of a number of types of polarizing filters such as polarized spectacles 218, hand-held polarizers 222 or rotating polarizers 234, either hand-turned (as shown here) or motorized (not shown). Additional details and variations are depicted and described herein in relation to FIGS. 8*a*, 8*b* and 9.

Figure 3:
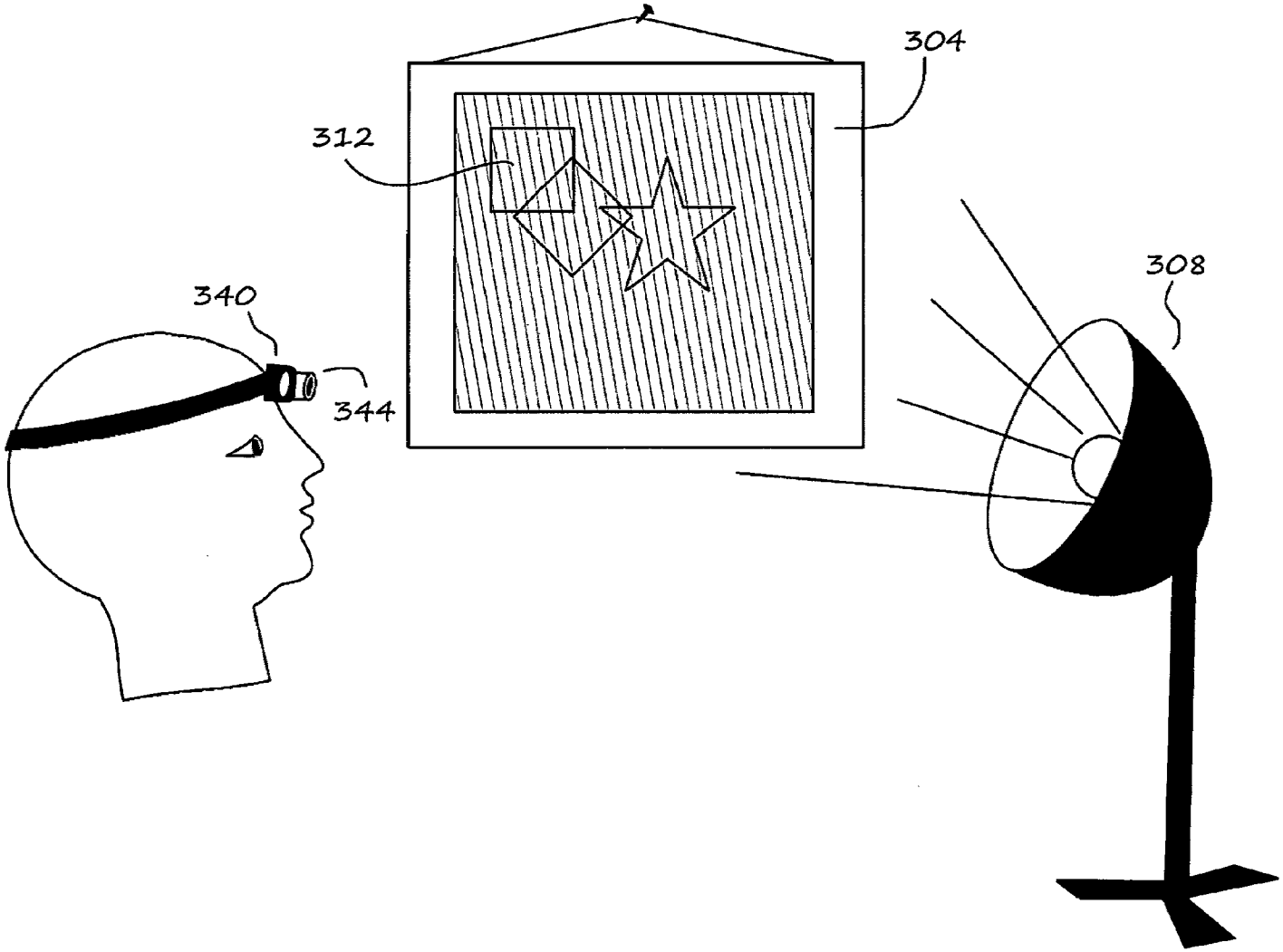
FIG. 3 is an illustration showing an embodiment of the present invention using a reflective type polarizer.

FIG. 3 illustrates an alternative embodiment in which the polarizer is reflective 304 and the source of light 308 is from the front of the display 312. Reflective polarizer can be manufactured using an aluminized reflector or may be made using a transmissive polarizer in front of a retroreflective surface. If a retroreflective surface is utilized, the light source must be located in close proximity to the eyes of the viewer such as described in U.S. Pat. No. 5,722,762 issued to Soll. Alternatively, a head lamp 340 such is well known can be used such as described in U.S. Pat. No. 5,115,382 issued to Smith. In an alternate embodiment, a polarizer 344 can be placed over the headlamp to illuminate the reflective display, thereby making its colors visible.

Figure 4:
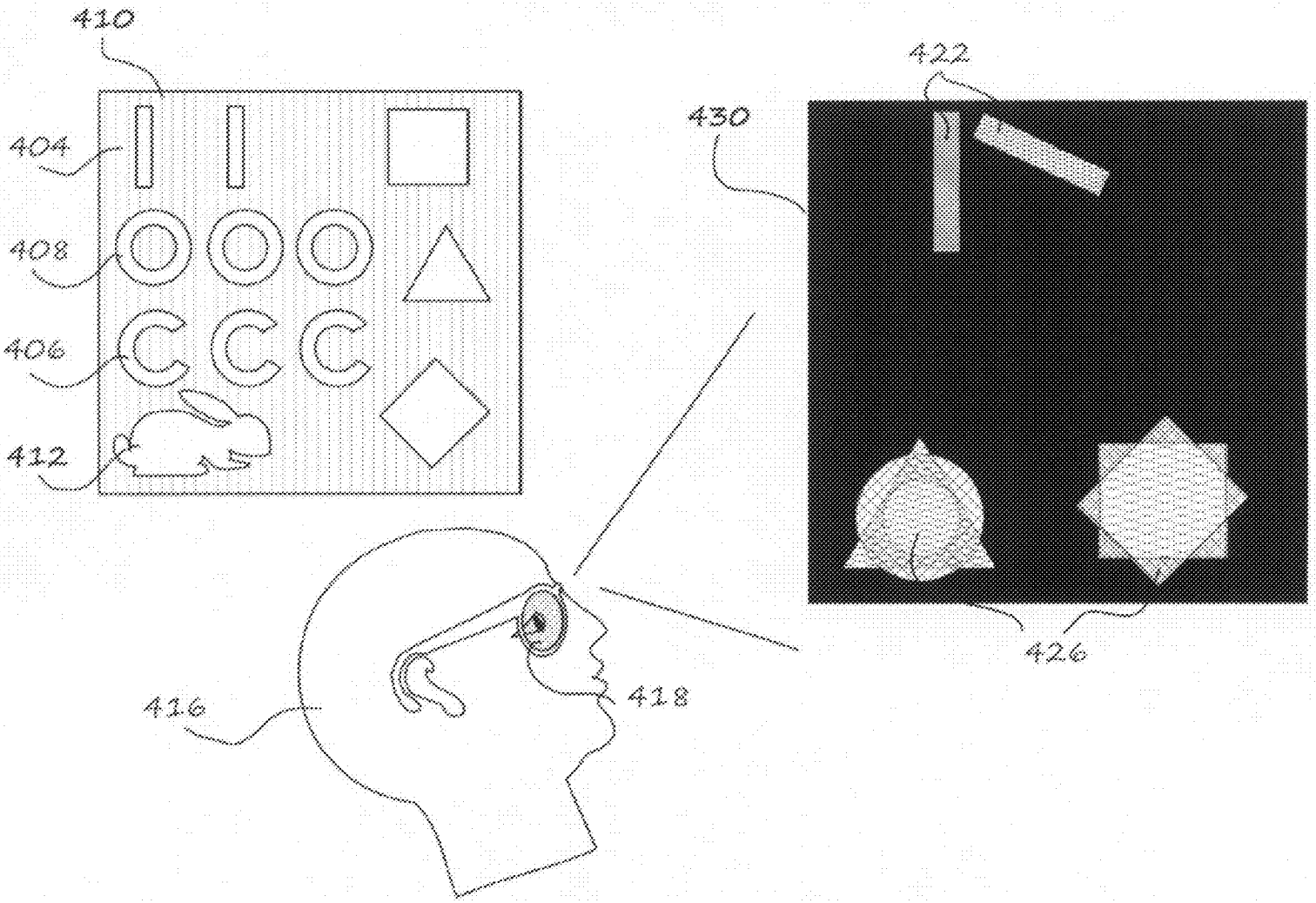
FIG. 4 illustrates the use of the present invention as an educational device.

FIG. 4 illustrates the use of the present invention as an educational device 400 to teach elementary subjects such as letter formation, word identification and the like. Here, components of letters such as straight lines 404, curves 406 and circles 408 are provided as shapes formed from the birefringent-vinyl lamination described above and adhered to a release sheet 410. Pictures of objects 412 can also be provided. The pupil 416 wears polarized spectacles 418 to see the various shapes 404, 406, 408 magically appear and, when rotated 422 and/or overlapped 426, dramatically change color when adhered to a polarizer 430.

Figure 5:
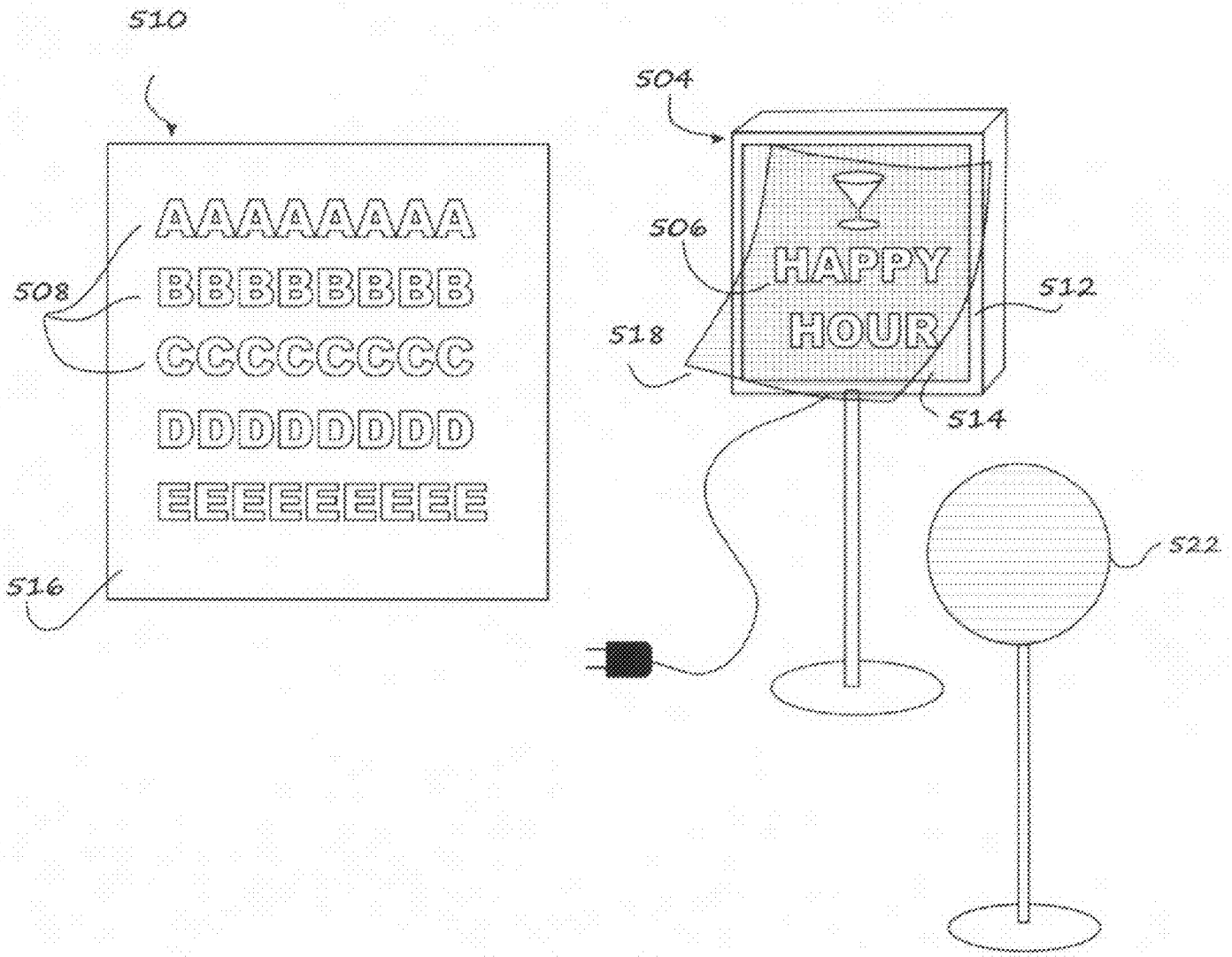
FIG. 5 is a drawing showing the use of the present invention as a changeable sign.

FIG. 5 shows the use of the present invention as a changeable sign 504. Here, words 506 are formed from letters 508 cut from the birefringent-vinyl lamination 510 described above and adhered to a back-lit glass plate 512 having a polarizer 514 adhered thereto. The polarizer 514 is preferably laminated between two sheets of self-adhering vinyl as described above. The letter-shaped laminations 508 are adhered to a smooth release sheet 516 for easy removal and placement on the sign 504. In this embodiment, once the words and/or symbols are placed on the sign, a lamination 518 of polarizer between two sheets of self-adhering vinyl is adhered over the sign 504 making it visible. Alternatively, to add a "magical touch," the front polarizer can be omitted and the sign made only visible through a separate polarizer 522. In this way, the sign can be "discovered" by passerbys who glimpse it as they move past.

Figure 6:
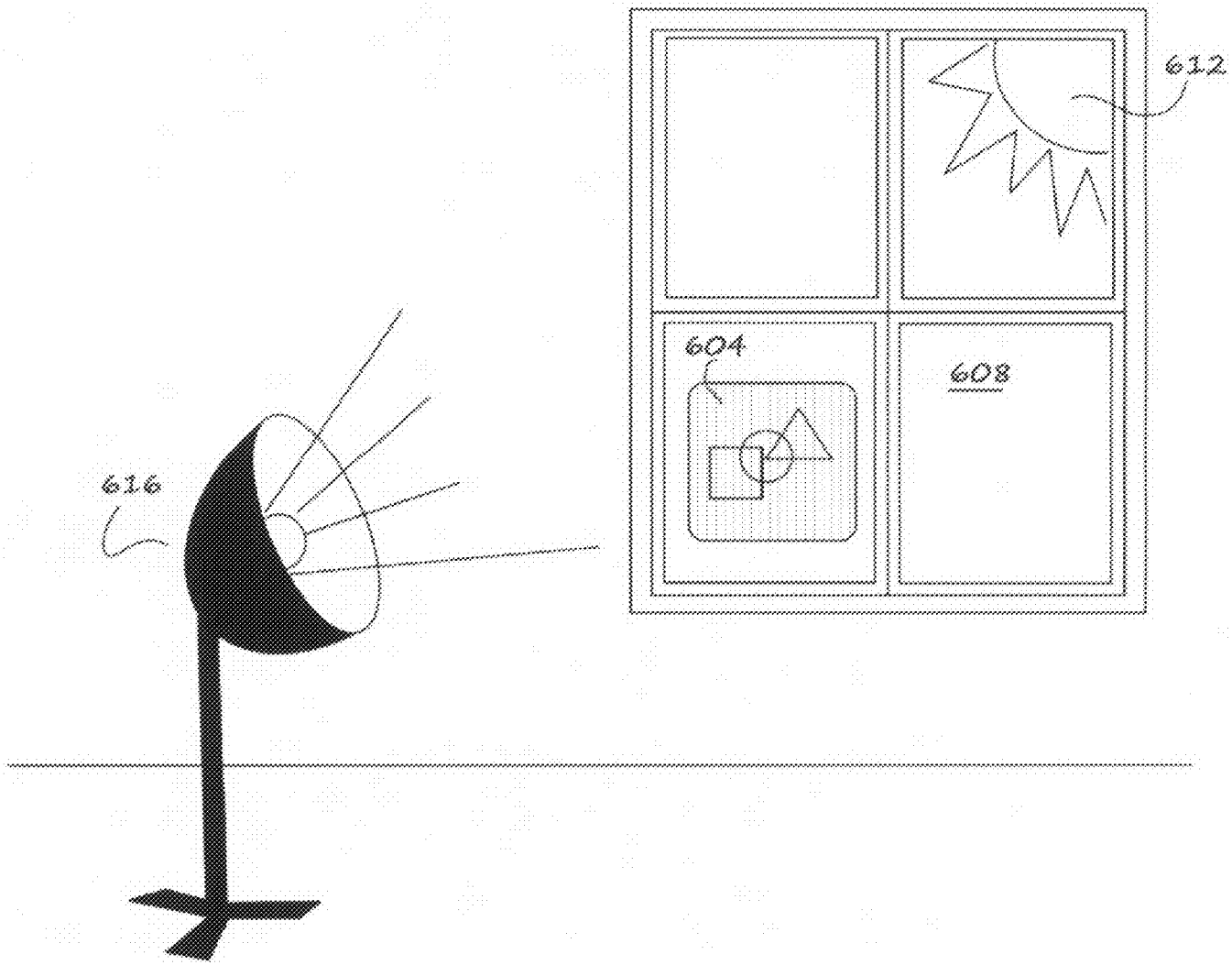
FIG. 6 illustrates an embodiment of the present invention utilizing "transflective" material.

FIG. 6 illustrates the use of "transflective" polarizer 604 behind the display. Transfective polarizer is made with a partly reflective backing such that light can pass through from the rear or be reflected from the front. This allows the display to be seen either in window or on a wall, for example. Here, the transflective polarizer 604 is shown laminated between two sheets of self-adhering vinyl as described above, and adhered to a window 608. In the daytime, daylight 612 illuminates the display from the rear. At night, a room light 616 illuminates the display from the front. Because of the inefficiency of both reflection and transmission of transflective polarizer, such a device requires significantly more light than a purely reflective or purely transmissive type. This is not to teach away from using transflective material, but to point out the need for special consideration (adequate lighting) when using it.

Figure 7:
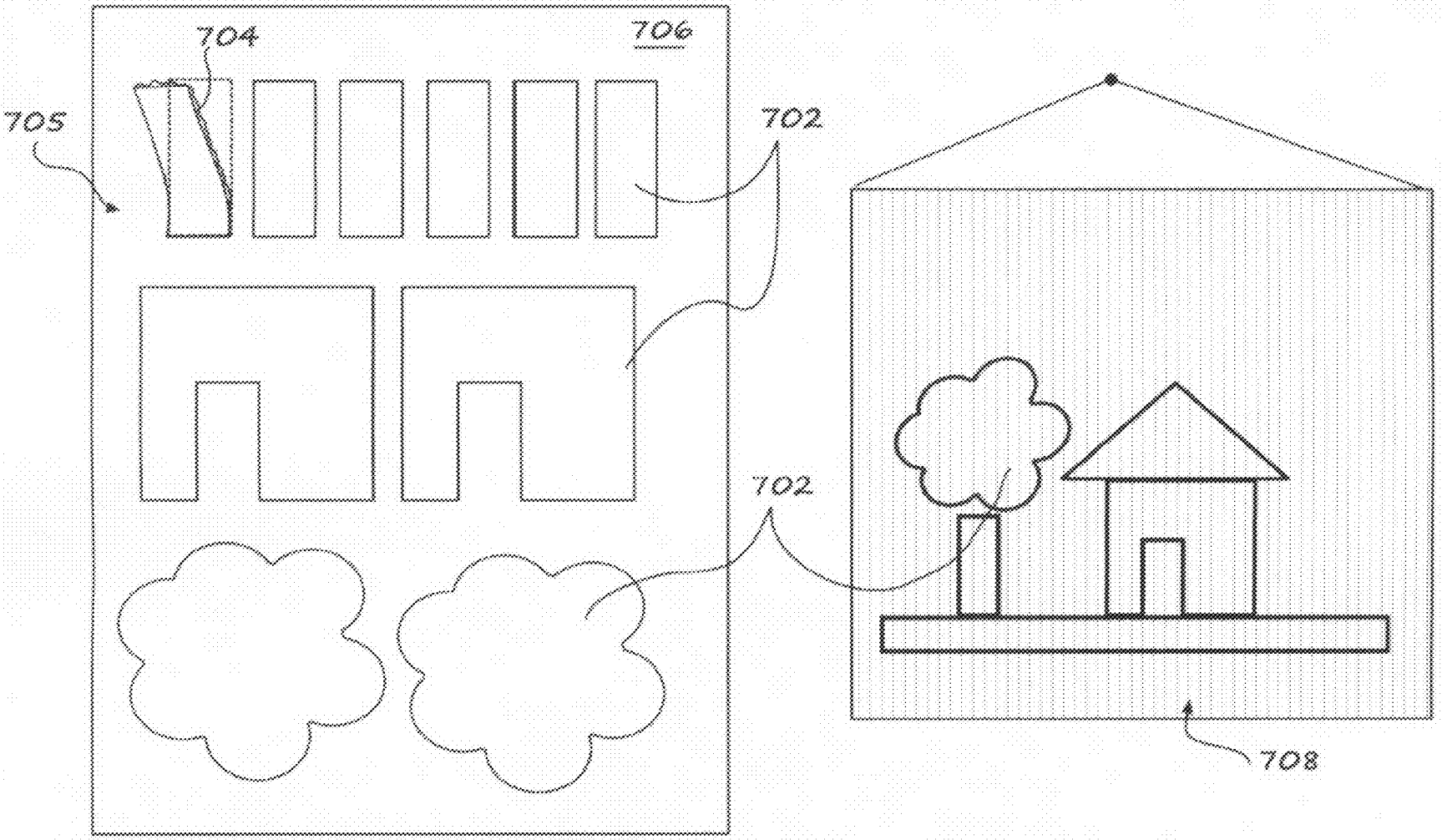
FIG. 7 illustrates an embodiment of the present invention wherein the birefringent shapes are not protected by adherent vinyl but, instead coated with low-tack adhesive.

FIG. 7 illustrates an alternative embodiment in which the birefringent material 702 is not laminated between vinyl, but instead coated on at least one side with clear-drying low-tack adhesive 704 (classified as "peelable or ultra-peelable" in the label industry). Such adhesive is similar to that used in the well-known 3M Company Corporation product "Post-It® Notes." This embodiment allows repositioning of the birefringent shapes 702 but, while significantly less expensive to manufacture, it is much less resilient than the vinyl laminated embodiment. If non-water-soluble and non-hygroscopic Ultra-low-tack adhesive is placed on BOPP, dirt can be rinsed from the adhesive to increase its useful life. Shown here is a tableau 705 of miscellaneous shapes adhered to a release backing 706. Further, in this embodiment, the plane polarizer 708 on which the shapes are adhered need not be enclosed in vinyl but can be standard polarizer, preferably protected on both sides, typically with triacetate, during manufacture. Polarizer which is not protected on one side is not as resilient as that protected on both sides and is highly susceptible to moisture attack, but is somewhat less costly. This type of apparatus would be less expensive to manufacture then the vinyl-laminated birefringent material described above, but is not nearly as resilient and not washable, although, if the right adhesive is used on a birefringent non-hygroscopic plastic film such as BOPP, can be gently rinsed. Nevertheless, such a design is advantageous where numerous re-uses of the same cut shapes are not needed or where the initial cost of manufacture is to be minimized.

Figure 8A:
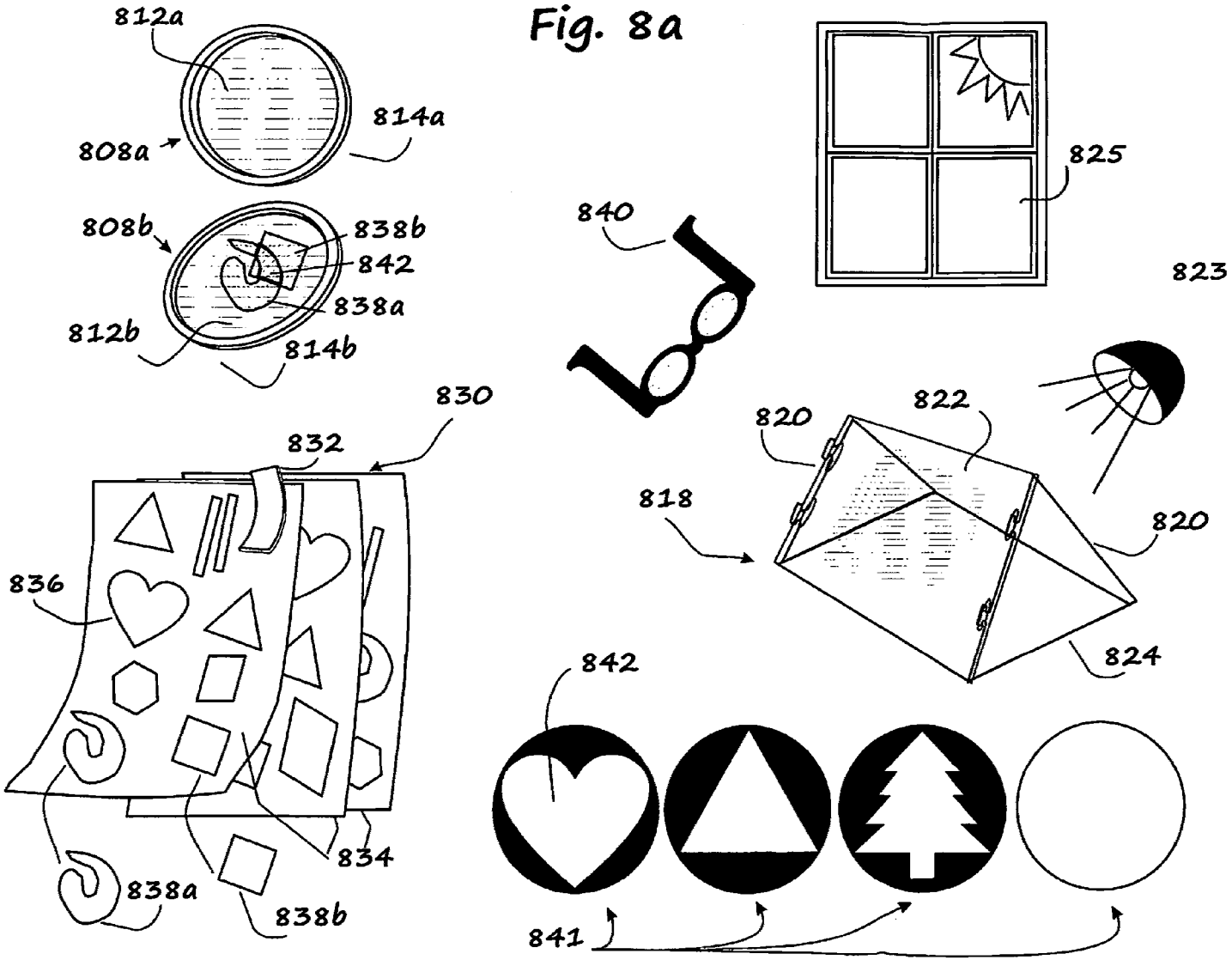
FIGS. 8*a* and 8*b* illustrate the present invention configured as a toy.
Figure 8B:
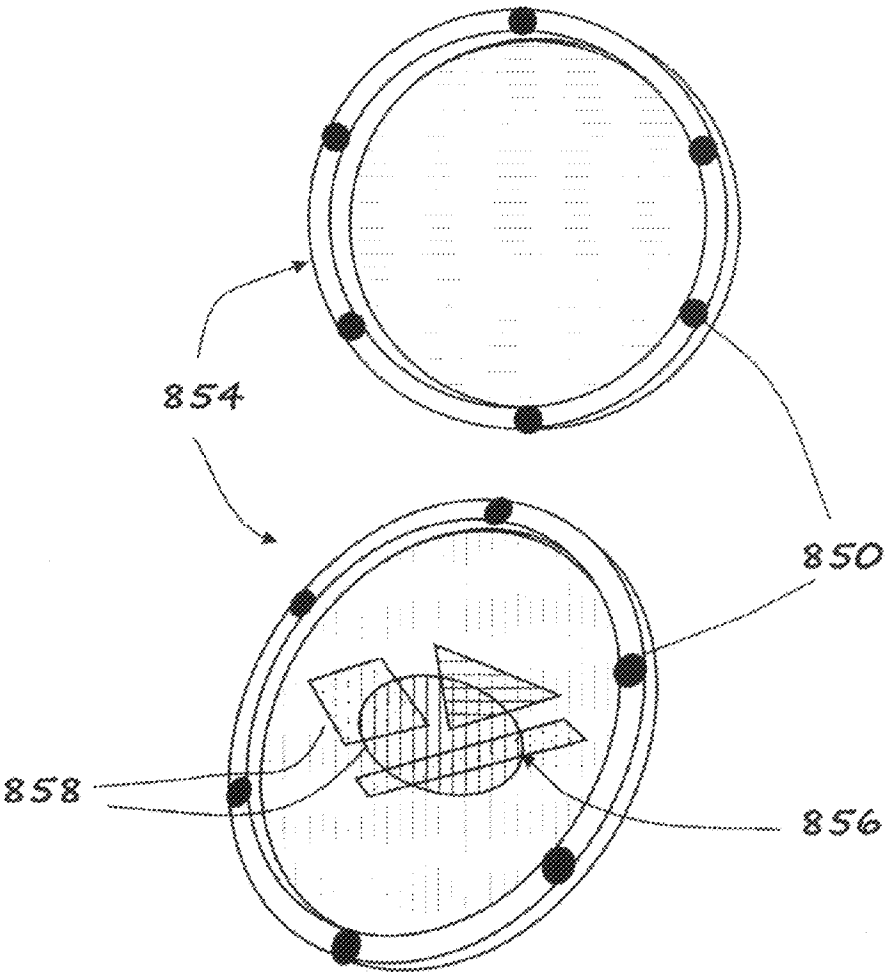

FIGS. 8*a* and 8*b* illustrate the present invention configured as a toy. In the embodiment illustrated in FIG. 8*a*, two nesting round polarizing filters 808*a* and 808*b* are manufactured by adhering round linear transmissive polarizing filters 812*a* and 812*b* to plastic rings 814*a* and 814*b*. One ring is smaller than the other allowing them to nest. Thus, it is convenient to rotate one or both rings in relation to each other. Also provided is a simple light table 818 created with cardboard sides 820 and a transmissive (clear or diffuse) plastic 822 work surface and a white reflective surface 824 disposed behind it. By reflecting light 823 off the white surface 824, the transmissive plastic surface 822 becomes a convenient light table work surface to create images. A window 825 may substitute for the light table. In addition, a variety of thicknesses of clear, colorless birefringent materials 830 are prepared with non-water-soluble, non-hygroscopic low-tack or ultra-low-tack adhesive 832 on at least one side and adhered to a release backing 834 which may be transparent or opaque. Preparing birefringent material such as BOPP with low-tack or, preferably, ultra-low-tack adhesive is well known in the film and tape industry. A variety of shapes 836 are steel rule die kiss-cut to create birefringent removable "stickers" 838. It is noted that the embodiment described in FIGS. 8*a* and 8*b* differs from that described in FIG. 2 primarily in the composition of the birefringent shapes. Also provided is one or more pairs of polarizing spectacles 840, although any polarizing sunglasses are well suited to use with this toy embodiment. Optionally, one or more clear, non-birefringent sheets of plastic 841 may be provided, with or without decorative design 842 pre-printed thereon, providing a Separable Art Assembly Surface.

An alternative embodiment can be made by adhering low tack adhesive to at least one side of at least one of the polarizing filters instead of on the birefringent shapes. In all other ways this embodiment is used in the same way as that with low-tack adhesive adhered to the birefringent shapes. This embodiment is considered less desirable because the shapes cannot be conveniently overlapped without falling apart, but may have cost advantages.

To use this toy embodiment, the user, wearing polarizing spectacles 840, places the first of the nesting polarizing circles 810*a* on the light table work surface 822 and provides a light source 823 to reflect off the white surface 824. Preferably the polarizing circle would be "crossed" with the user's polarizing spectacles 840 such that it appears dark. If provided, the user would place one of the clear sheets 841, with or without a decorative design pre-printed thereon, over the first polarizer forming the a separable art assembly surface. The clear sheet is sized and shaped to fit conveniently with the first polarizer. Then the user selects a shape 838*a* from the "stickers" 838 and places it on the clear plastic Art Assembly Surface 841 or directly on the first polarizing filter 810*a* which is on the light table work surface 822 and is back-lit by light reflected from the white reflective surface 824. By looking through polarized spectacles 840, the user will see a color in the birefringent sticker 838 when held in front of the polarizing circle 810. By rotating the sticker 838 in relation to the polarizing filter 810 the user will see the sticker change color. When the user is satisfied with the color and orientation of the sticker, she can adhere it to the art assembly work surface or directly on the polarizing filter on the work surface. The user may then select another sticker 838*b* and repeat the foregoing steps. However, when the second sicker is placed between the original sticker and the user's eyes, yet a different set of colors will be visible in the overlapping area 842. The process is repeated until the user is satisfied with their complete artwork creation 843. At that point she my remove her polarizing spectacles 840, take the second nesting polarizing filter 812*b* and place it over the first nesting polarizing filter 812*a*. The second nesting polarizing filter 812*b* can then be rotated in relation to the first polarizing filter 812*a* causing the colors of the birefringent stickers to change. The assembly can be conveniently hung in front of a window or other light source for display. If a separable Art Assembly Surface 841 is used, the entire creation may be removed from the polarizing filter and a new creation may be made using the same polarizing filter without the need to remove all the sticker shapes 838.

Owing to the use of low-tack adhesive, the entire creation can be taken apart and the shapes placed back on the release backing 834 for later reuse. Since the material and adhesive are non-water soluble and non-hygroscopic, they may be gently rinsed off if they become dirty increasing their useful life.

FIG. 8*b* illustrates another embodiment of the present invention in which, rather than using nesting rings, one or more magnetic attachments 850 are used to hold two polarizers 854 together. These polarizers may be made in any shape desired. Similarly to the embodiment described in FIG. 8, the two polarizers 854 may be rotated relative to each other causing the colors of the artwork 856 made of birefringent stickers 858 to change. In all other respects, the embodiment shown in FIG. 8*b* is used in the same way as that shown in FIG. 8*a*. Any method or device for temporarily holding the two polarizers in place such as low-tack adhesive may also be used to adhere the two polarizers together without changing the teaching of the present invention.

Figure 9:
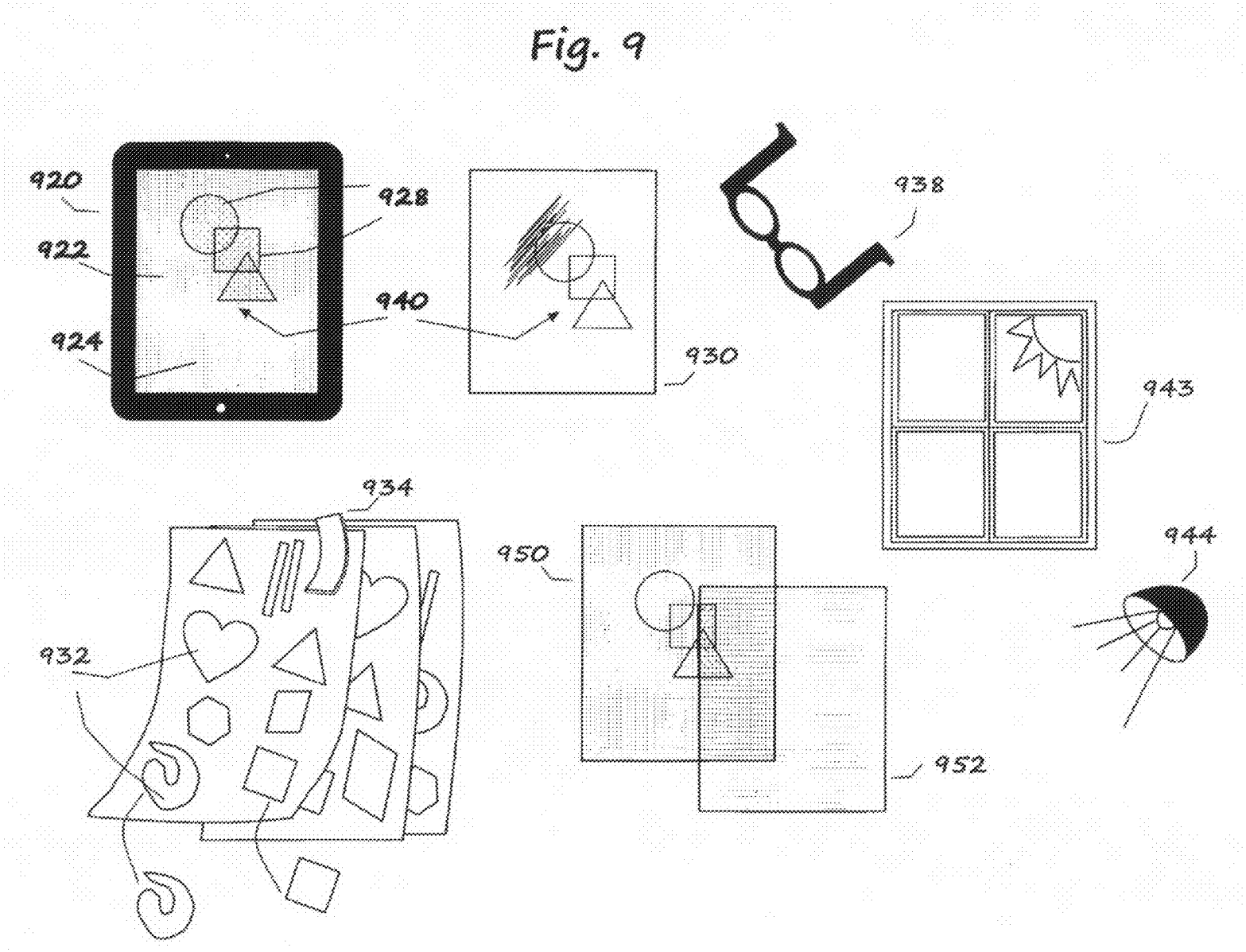
FIG. 9 illustrates an alternative embodiment of the present invention using a device with a liquid crystal display as a work surface.

FIG. 9 illustrates an alternative embodiment of the present invention using a liquid crystal display ("LCD") as a work surface. In the foregoing embodiments, at least two polarizers are required, one for polarizing the incoming light and the other an "analyzer" for seeing the image. We have found a convenient way to create and use the present invention using certain liquid crystal displays as both a source of light and a polarized light source. In recent years liquid crystal displays have become ubiquitous and increasingly used in portable devices such as "tablet" computers having glass, touch-screen back-lit screens. Because liquid crystal displays use polarized light, the light emitted from the screen is polarized. Manufacturers choose to orient the polarizer on the face of the screen at various angles, usually 45 degrees, but often 90 degrees or zero degrees. It should be noted that some liquid crystal displays may utilize compensating filters which elliptically or circularly polarize the light emitted from the screen. Such screens are not usable in the present invention, as will become clear below.

To create the present invention using an LCD as the work surface, a device preferably having a backlit display is chosen. The display must have the property of blanking-out (becoming substantially opaque) when viewed through a plane polarizing filter at certain angles, preferably 90 degrees or zero degrees. We have found that the certain "tablet computers" or personal digital assistants ("PDAs"), notably the Apple iPad 920 product manufactured at the time of this invention is ideal for this use, but this invention is not limited to this product. The surface 922 of the device should be glass but may be any transparent material. An executable program or application (colloquially known as an "App") is executed which presents a white background 924. Optionally, shapes 928 can be displayed on the screen as guides for creating a picture. The shapes can be provided or created by the user using well-known line-drawing algorithms or by selecting shapes from library of pre-drawn shapes and moving them to desired positions on the screen. The shapes may be generated by the device's computer capability or merely stored as images for display such as a 'digital picture frame" well-known to the general public. A non-birefringent sheet of clear plastic 930 such as triacetate or acrylic is provided to place over the LCD surface. As in the embodiment described in FIGS. 8*a* and 8*b*, "sticker" shapes 932 made of clear, colorless birefringent material such as BOPP are provided having ultra-low-tack adhesive adhered to least one side 934. The user wears polarizing spectacles 938 and places the "sticker" shapes 932 on the clear plastic 930 to create a desired arrangement or picture 940. While the stickers may be placed directly on the display surface 922, the separate clear plastic surface 930 is more convenient in that, to use the tablet for other purposes, the individual stickers 932 need not be removed when the user is done playing. In addition, the separate clear surface 930 may be separately displayed in a window 943 or in front of another light source 944 when complete. To do this, a polarizer 950 must be provided to place behind the completed work when not displayed on the LCD screen. A second sheet of polarizer 952 may be provided to place over the completed picture so viewers need not wear polarizing spectacles 938.

While it is possible to use a reflective LCD display in ambient incident light, we have found the back-lit screen to be ideal and far superior.

PREFERRED EMBODIMENT

As discussed above, the preferred embodiment of the invention comprises clear, colorless BOPP having non-water soluble, non-birefringent clear Ultra-low-tack Adhesive adhered to at least one side. The surface of the BOPP is treated with processes well-known in the packaging printing industry such as corona treatment or plasma coating to effect preferential adherence of the adhesive to the BOPP versus the clear substrate 930. Plasma coating may also be used to increase the film's hydrophobic properties. A variety of thicknesses of BOPP are used to provide a variety of colors when illuminated with polarized light and viewed through a polarizing filter or polarized spectacles. The thicknesses are selected by visually inspecting each source of BOPP using polarizing filters on both sides of the cellophane and back-lighting it. The BOPP is steel rule die kiss-cut into desired shapes and, where feasible, the matrix is removed. Two pieces of plane polarizing filter of nominally 0.010" thickness are held in mutually independent rotating holders that can be adhered to a window or other light source for creating and then showing the complete picture.

The embodiment described in FIG. 8*a* using an inexpensive light table made from cardboard and clear plastic having a reflective surface spaced below the plastic, and nesting plastic rings holding polarizers is considered the best mode due to the low cost and avoids the need to have a back-lit LCD device as described on FIG. 9.

The preferred polarizer is the Iodine type with triacetate protection on both sides as is well-known in the industry. Any other type of polarizer, such as dye type, will be acceptable, but the more neutral the color and the more highly efficient the polarizer is, the better. We have found HN38 type iodine-PVA neutral density linear polarizer to be a good choice. In use, one of the two nesting rings holding a polarizer is removably adhered to a smooth surface such as a day-lit window or computer screen that is programmed with a luminous white blank field. Shapes die-cut from BOPP and prepared with a layer of non-water-soluble, ultra-low-tack clear, non-birefringent adhesive are selected by the user and adhered to the first polarizer ring. The user wears polarized spectacles to see what she is creating. When complete, the second nesting ring holding a polarizer is placed within or around the first so the completed picture can be viewed by anyone not wearing polarized spectacles. While the foregoing is considered to be the best mode of making and using the present invention, it is not intended to be limiting, or to implicitly teach away from other modes.

The specific implementations disclosed above are by way of example and for enabling persons skilled in the art to implement the invention only. We have made every effort to describe all the embodiments we have foreseen. There may be embodiments that are unforeseeable or which are insubstantially different. We have further made every effort to describe the invention, including the best mode of practicing it. Any omission of any variation of the invention disclosed is not intended to dedicate such variation to the public, and all unforeseen or insubstantial variations are intended to be covered by the claims appended hereto. Accordingly, the invention is not to be limited except by the appended claims and legal equivalents.

What is claimed is:

1. A toy comprising: at least one linear polarizing filter, a variety of pre-cut birefringent shapes, said toy further comprising low-tack adhesive, and at least one linear polarizer analyzer.

2. The toy of claim 1 wherein said birefringent shapes comprise said low-tack adhesive adhered to at least one side of said birefringent shapes.

3. The toy of claim 1 wherein said at least one linear polarizing filter comprises low-tack adhesive adhered to at least one side of said at least one linear polarizing filter.

4. The toy of claim 1 wherein said low-tack adhesive comprises ultra-low-tack adhesive.

5. The toy of claim 1 wherein said precut birefringent shapes are surface-treated prior to being coated with said low-tack adhesive.

6. The toy of claim 1 wherein said linear polarizer analyzer comprises polarized spectacles.

7. The toy of claim 1 wherein said at least one linear polarizing filter is retained by a first ring, and said toy further comprising a second polarizing filter retained by a second ring, said first and second rings rotationally movable in relation to each other.

8. The toy of claim 1 further comprising a transmissive work surface having a light-reflecting surface disposed behind it and separated by a distance adequate to permit illumination to enter the space between said transmissive work surface and said light-reflecting surface.

9. The toy of claim 1 wherein said birefringent shapes comprise BOPP film.

10. A toy comprising at a liquid crystal display, a variety of birefringent shapes having low-tack adhesive adhered to at least one side, at least one linear polarizing analyzer.

11. The toy of claim 10 further comprising at least one clear, non-birefringent substrate suitable for temporarily adhering said birefringent shapes.

12. A toy comprising at least 2 linear polarizing filters, a multiplicity of birefringent shapes, said toy further having one or more magnetic attachments facilitating holding said polarizing filters to each other on each side of an arrangement of said birefringent shapes disposed between said polarizing filters, to facilitate viewing of birefringent colors in said birefringent shapes.

13. The toy of claim 12 wherein at least one of said polarizing filters comprises low-tack adhesive preferentially adhered to at least one side.

14. A toy of comprising shapes of birefringent film laminated between two vinyl films, wherein at least one of said vinyl films is static cling, said toy further comprising at least one linear polarizing filter.

* * * * *